US007780483B1

(12) United States Patent
Ravlich

(10) Patent No.: US 7,780,483 B1
(45) Date of Patent: Aug. 24, 2010

(54) ELECTRICAL PRESS-FIT CONTACT

(76) Inventor: Anthony Ravlich, 27212 Westridge La., Laguna Hills, CA (US) 92653

( * ) Notice: Subject to any disclaimer, the term of this patent is extended or adjusted under 35 U.S.C. 154(b) by 0 days.

(21) Appl. No.: 12/316,243

(22) Filed: Dec. 9, 2008

(51) Int. Cl.
*H01R 13/42* (2006.01)

(52) U.S. Cl. ..... 439/751; 439/82

(58) Field of Classification Search ..... 439/82, 439/84, 751
See application file for complete search history.

(56) References Cited

U.S. PATENT DOCUMENTS

| | | | | |
|---|---|---|---|---|
| 4,606,589 | A * | 8/1986 | Elsbree et al. | 439/78 |
| 4,701,140 | A | 10/1987 | Orbanic | |
| 4,737,114 | A * | 4/1988 | Yaegashi | 439/82 |
| 4,828,514 | A | 5/1989 | Johnson et al. | |
| 4,857,018 | A * | 8/1989 | Pickles | 439/751 |
| 5,139,446 | A * | 8/1992 | Costello et al. | 439/751 |
| 5,564,954 | A * | 10/1996 | Wurster | 439/751 |
| 6,077,128 | A | 6/2000 | Maag et al. | |
| 6,098,281 | A | 8/2000 | Rudi | |
| 7,008,272 | B2 | 3/2006 | Blossfeld | |
| 7,344,389 | B2 | 3/2008 | Kramski | |
| 7,377,823 | B2 | 5/2008 | Chen | |
| 2003/0236009 | A1 * | 12/2003 | Tsuchiya | 439/82 |
| 2005/0250356 | A1 | 11/2005 | Matsumura et al. | |
| 2007/0212907 | A1 | 9/2007 | Kramski | |
| 2008/0050946 | A1 | 2/2008 | Nunokawa et al. | |

* cited by examiner

*Primary Examiner*—Hien Vu
(74) *Attorney, Agent, or Firm*—Dennis W. Beech

(57) ABSTRACT

The present invention may be used for press-fit insertion into an electrical contact hole or an electrical solderless contact. An electrical contact may have a contact portion, an insert portion and a position portion therebetween. There may be an insert guide portion at an insert end and a resilient portion rearward thereof. The resilient portion may have an opening through the sides formed as an elliptically shaped portion with an oblong end portion at each end along a longitudinal axis of the electrical contact. The resilient portion may have a first beam and a second beam spaced apart and arched with a convex outside edge symmetrically located along the longitudinal axis. A first projection and a second projection may be spaced apart and opposed orthogonal to the longitudinal axis on an inner surface of the opening.

5 Claims, 2 Drawing Sheets

ELECTRICAL PRESS-FIT CONTACT

BACKGROUND OF THE INVENTION

This invention relates to devices for press-fit insertion or solderless electrical contact into an electrical contact hole of a device or object, for example, a printed circuit board. The new electrical press-fit contact device may have a resilient portion with a combination elliptical and oblong opening positioned to form two convex curved spaced apart beams with opposed projections on an inner surface.

Electrical press-fit or solderless contact devices may currently be known in the art to have an insertion portion, a position portion and a contact portion. These devices may have an opening, slot, slit, eyelet or the like formed in an insertion portion. The opening may have opposed spaced apart protuberances in the opening positioned to be crushed, wedged or otherwise deformed to add more force or pressure to the fit of the device in an electrical contact hole, such as in a printed circuit board. The device having protuberances may have axial symmetrical deformable beams defined around the opening. The interior opening, abutting corners and exterior edges of the device may have intersecting surfaces or sides that are angular or have steps rather than a transitioning smooth arc surface interface. Various openings may be wider or broader at the longitudinal ends than in the center of the opening, which may allow for cracking at the beam merging ends due to insufficient structural support.

SUMMARY OF THE INVENTION

The present invention is directed to devices for press-fit insertion into an electrical contact hole or as an electrical solderless contact. An electrical contact may have a contact portion, an insert portion and a position portion therebetween. There may be an insert guide portion at an insert end and a resilient portion rearward thereof. The resilient portion may have an opening through the sides formed as an elliptically shaped portion with an oblong end portion at each end along a longitudinal axis of the electrical contact. The resilient portion may have a first beam and a second beam spaced apart and arched with a convex outside edge symmetrically located along the longitudinal axis. A first projection and a second projection may be spaced apart and opposed orthogonal to the longitudinal axis on an inner surface of the opening.

These and other features, aspects and advantages of the present invention will become better understood with reference to the following drawings, description and claims.

DETAILED DESCRIPTION

The following detailed description represents the best currently contemplated modes for carrying out the invention.

The description is not to be taken in a limiting sense, but is made merely for the purpose of illustrating the general principles of the invention.

Figure 2:
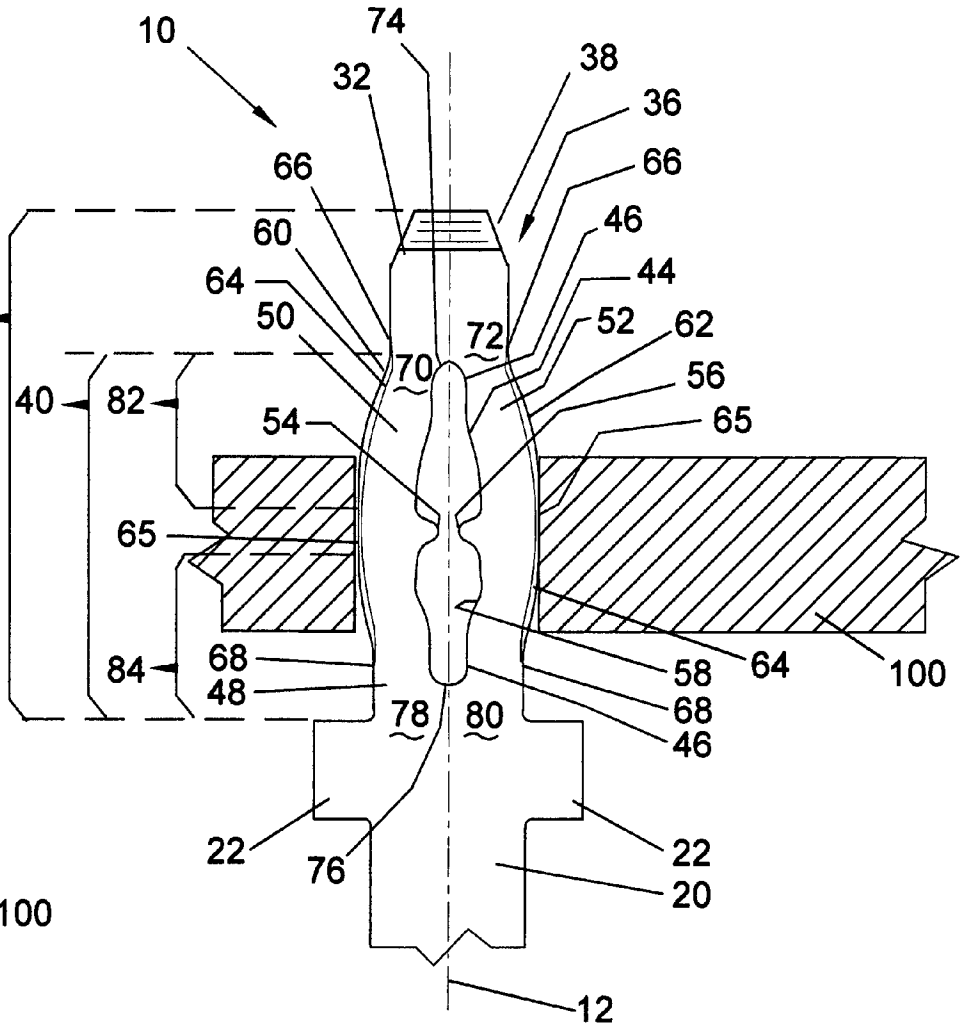
FIG. 2 illustrates a side view of an electrical press-fit contact according to an embodiment of the invention.
Figure 1:
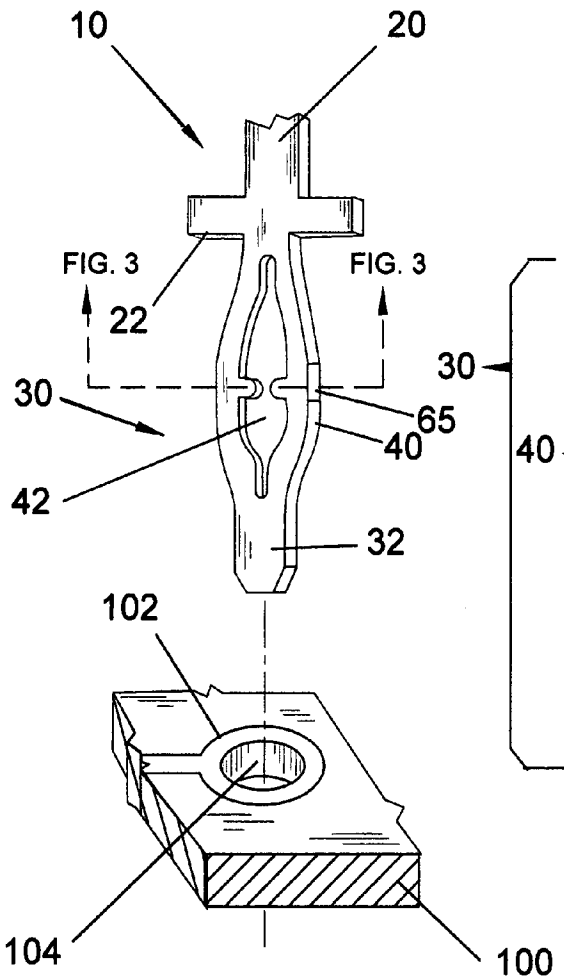
FIG. 1 illustrates a perspective view of an electrical press-fit contact and portion of a circuit board according to an embodiment of the invention.
Figure 4:
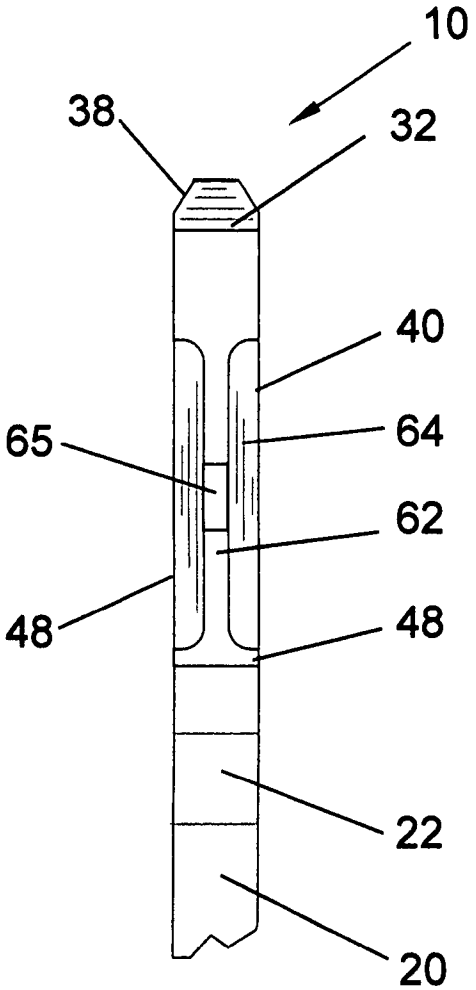
FIG. 4 illustrates a cross-sectional view along line A-A in FIG. 2 according to an embodiment of the invention.
Figure 3:
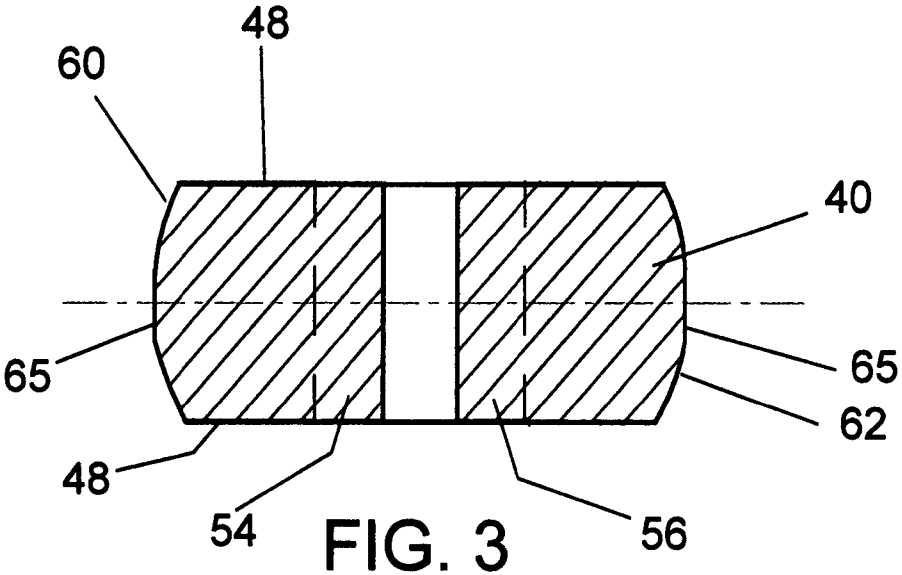
FIG. 3 illustrates an edge view of an electrical press-fit contact according to an embodiment of the invention.

Referring to FIGS. 1 through 4, and electrical solderless contact 10 may have an insert portion 30, a position portion 22 and a contact portion 20 that may be aligned along a longitudinal axis 12. The contact portion 20 may be an electrical contact structure or pin to interface with a device or object, for example, wire, cable, multi-pin connectors, switches, component housings, switches, modules, integrated circuits, solid state devices, discrete components, etc. The position portion 22 may have various shapes, such as a projecting step or shoulder, and may be located on contact 10 to allow insertion in a device or object, such as, a through-hole 102 of a printed circuit board 100, for proper connection and position of the contact 10.

The insert portion 30 may have an insert guide portion 32 and a resilient or press-fit portion 40. The insert guide portion 32 may be at the insert end 36 or forward end of the contact 10 and may have a beveled tip 38 to aid in inserting the contact 10 in a hole.

The resilient portion 40 may have an opening 42 through the sides 48 that has generally an elliptical shape portion 44 with oblong end portions 46 aligned along the longitudinal axis 12. Two beams 50, 52 or lobes that may be arched may be formed symmetrically along the longitudinal axis 12 and may be spaced apart by opening 42. There may be two opposed, spaced apart projections 54, 56 positioned on the inner surfaces 58 of the opening 42 approximately longitudinally centered along the portion of the longitudinal axis 12 in the opening 42 or positioned along a lateral axis that may intersect an apex or vertex defined as the widest distance point between the outside convex edges 60, 62. The outside edges 60, 62 of the insert guide portion 32 and most of the resilient portion 40 may have a curved surface 64 to allow maximum contact with a through-hole 102 inner electrical contact surface 104. This may also aid in inserting a contact 10 and reduce metal scoring due to right angle edges.

The beam 50, 52 may be formed of electrical conductive material or a base material that is plated to form a resilient arc beam structure. The shape of the beams 50, 52 cause a bulging lobe effect at the outside edges 60, 62 that will be deformed when the resilient portion 40 may be forced into a through-hole 102. The deforming action may cause the beams 50, 52 to move toward the longitudinal axis 12 thereby constricting the opening 42. The movement may or may not cause the projections 54, 56 to touch. The projections 54, 56 should be of sufficient rigid construction to inhibit further deforming of the beams 50, 52 once the projections 54, 56 touch.

The outside edges 60, 62 of the insert portion 30 transition from a generally parallel form on the insert guide portion 32 to a convex curve form relative to the longitudinal axis 12 on the resilient portion 40. The resilient portion 40 may transition to a generally parallel form adjacent to the position portion 22. The transitions at 66, 68 of the outside edges 60, 62 between the guide portion 32, the resilient portion 40 and adjacent the position portion 22 may be in the form of arcs of circles to avoid sharp edge steps or angular transition locations that may result in cracks forming adjacent the merging locations 66, 68 of the beams 50, 52 as has been found with prior structures.

The beams 50, 52 merge at first end portions 70, 72 adjacent the transition edges 66 and at the opening insert end 74. The beams 50, 52 merge at second end portions 78, 80 adjacent the transition edges 68 and at the opening contact end 76. The narrower shape of the oblong end portions 46 of the opening 42 may provide additional material strength structure to resist cracking or adverse deformation of the beams as may be caused in existing contact structures. In addition, as discussed above, the projections 54, 56 may prevent excessive deformation of the beams to guard against cracking or adverse deformation. An example of adverse deformation may be the cracking and excessive bending of one beam 50, 52 relative to the second beam such that the contact becomes bent relative to the axis 12 and provides poor electrical contact or retention force in a hole. By setting a proper tolerance for the spacing between opposed projections 54, 56 and the beam material strength, contacts 10 may be forced into tolerance openings, but not forced into out of tolerance holes that may damage the contact 10 that may result in failure in use.

A further feature of the contact 10 may be to shape the beams 50, 52 with a longer insert end portion 82 relative to the contact end portion 84. This may also offset the location of the projections 54, 56 along the longitudinal axis 12 toward the opening contact end 76. The longer insert end portion 82 may allow a longer incline surface on outside edges 60, 62 for forcing the contact 10 into a through-hole 102, but allow the same electrical contact with the hole 102 inner surface.

Experiments with electrical solderless contacts for holes having 1.0 to 1.6 millimeter diameter and board holes between 58 and 63 one thousands inch for contacts and board holes having plated tin or silver to silver contact found good performance in insertion and approximately a 100 or more newton retention force for 1.6 mm size hole. Many specifications for such through-holes require a minimum of 50 newtons and prefer at least 60 newton retention force for 1.0 mm diameter holes.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device for press-fit an electrical contact hole comprising:

an electrical contact with a contact portion, an insert portion and a position portion therebetween;

an insert guide portion disposed at an insert end of said insert portion;

a resilient portion between said insert guide portion and said position portion wherein said resilient portion has an opening therein formed as an elliptical shaped portion with an oblong end portion extending from said elliptical shaped portion and disposed at each end of said resilient portion along a longitudinal axis of said electrical contact;

said resilient portion comprising a first beam and a second beam spaced apart and arched with a convex outside edge symmetrically disposed along said longitudinal axis, and a first projection and a second projection spaced apart and opposed orthogonal to said longitudinal axis disposed on an inner surface of said opening; and said insert guide portion has two approximately parallel opposed outside edges that transition in a first concave curved arc to said convex outside edges at a first transition edge forward of an opening insert end; and said convex outside edges transition in a second concave curved arc to said position at a second transition edge forward of an opening contact end;

wherein said first beam and said second beam merge at a first end portion adjacent said opening insert end and at a second end portion adjacent said opening contact end; and wherein said two opposed outside edges and said convex outside edges have a curved lateral surface.

2. The device as in claim 1 wherein said insert end has a beveled tip end.

3. The device as in claim 1 wherein said first projection and said second projection are rigidly constructed.

4. The device as in claim 1 wherein said first beam and said second beam are longer in an insert end portion attached to said insert end relative to the length of a contact end portion, and said first projection and said second projection are disposed along a lateral axis intersecting an apex of said convex outside edges.

5. The device as in claim 1 wherein said first projection and said second projection are disposed along a lateral axis intersecting an apex of said convex edges.

* * * * *